US008695714B2

(12) United States Patent
Xu et al.

(10) Patent No.: US 8,695,714 B2
(45) Date of Patent: Apr. 15, 2014

(54) EASY DRILL SLIP WITH DEGRADABLE MATERIALS

(75) Inventors: Richard Yingqing Xu, Tomball, TX (US); Zhiyue Xu, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 512 days.

(21) Appl. No.: 13/111,181

(22) Filed: May 19, 2011

(65) Prior Publication Data

US 2012/0292053 A1 Nov. 22, 2012

(51) Int. Cl.
*E21B 29/02* (2006.01)

(52) U.S. Cl.
USPC ..... 166/376; 166/387; 166/118

(58) Field of Classification Search
CPC . E21B 29/02; E21B 33/1293; E21B 33/1204; E21B 33/129
USPC ..... 166/118, 134, 192, 376, 387
See application file for complete search history.

(56) References Cited

U.S. PATENT DOCUMENTS

| | | | | |
|---|---|---|---|---|
| 4,673,039 | A | 6/1987 | Mohaupt | 166/281 |
| 6,167,963 | B1 | 1/2001 | McMahan et al. | 166/179 |
| 6,494,261 | B1 | 12/2002 | Pahmiyer | 166/281 |
| 6,708,768 | B2 * | 3/2004 | Slup et al. | 166/382 |
| 8,342,094 | B2 * | 1/2013 | Marya et al. | 102/306 |
| 2010/0276159 | A1 | 11/2010 | Mailand et al. | 166/387 |
| 2011/0048743 | A1 | 3/2011 | Stafford et al. | 166/386 |
| 2012/0125642 | A1 * | 5/2012 | Chenault et al. | 166/387 |

* cited by examiner

*Primary Examiner* — William P Neuder
*Assistant Examiner* — Richard Alker
(74) *Attorney, Agent, or Firm* — Shawn Hunter

(57) ABSTRACT

Slip elements for a bridge plug include an inner body portion that is substantially formed of a material that is degradable by dissolution in response to a dissolving fluid and a hardened, resilient, radially outer contact portion. The outer contact portion includes a plurality of openings that function as stress risers. The inner body portion may be formed of magnesium powder.

18 Claims, 5 Drawing Sheets

EASY DRILL SLIP WITH DEGRADABLE MATERIALS

BACKGROUND OF THE INVENTION

1. Field of the Invention

The invention relates generally to the design of bridge plug slips.

2. Description of the Related Art

Bridge plugs are used to form closures in a flowbore. Typically, bridge plugs have a plug body with slip elements that can be selectively moved radially outwardly to bitingly engage a surrounding tubular member. One type of bridge plug is described in U.S. Pat. No. 6,167,963 issued to McMahan et al. That patent is owned by the assignee of the present application and is incorporated herein by reference.

Often, a bridge plug will need to be removed after it has been set, and this is usually done by milling through the plug. Unfortunately, milling through most conventional bridge plug designs leaves large pieces which may be difficult to circulate out of the flowbore.

SUMMARY OF THE INVENTION

The present invention provides a design for a bridge plug wherein the slip elements of the bridge plug include an inner body portion that is substantially formed of a material that is degradable by dissolution in response to a dissolving fluid and a hardened, resilient, radially outer contact portion. In described embodiments, the outer contact portion is substantially formed of a hardened material, such as cast iron, that is shaped to provide for biting into a surrounding tubular member. In described embodiments, the outer contact portion extends from the upper end of the slip element to the lower end of the slip element. Also in described embodiments, the outer contact portion includes a plurality of openings that function as stress risers.

In described embodiments, the inner body portion is substantially formed of a material that is dissolvable in response to a dissolving agent. In one current embodiment, the dissolvable material forming the inner body portion comprises magnesium powder. When the dissolvable material is magnesium powder, the dissolving agent may be potassium chloride (kcl).

As described, the slip inserts are cast within a surrounding molding to create a slip ring which can then be disposed onto the setting cone of the bridge plug. In described embodiments, the molding is a phenolic material which provides a laminate covering for the slip elements that protects the dissolvable material against premature dissolution.

In operation, the bridge plug is disposed into a flowbore and then set. When it is desired to remove the bridge plug from the flowbore, a milling device is used. During removal of the plug by milling, the molding of the slip ring is ruptured by the mill, which exposes the dissolvable material forming the inner body portions to wellbore fluid which contains the dissolving agent. The dissolving agent dissolves away the inner body portions, leaving the outer contact portions of the slip elements. The presence of openings disposed through the outer contact portions assists in disintegration of the outer contact portions into smaller component parts via operation of the milling device. The outer contact portions, or portions thereof, and other components of the bridge plug may be circulated out of the wellbore via fluid returns.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
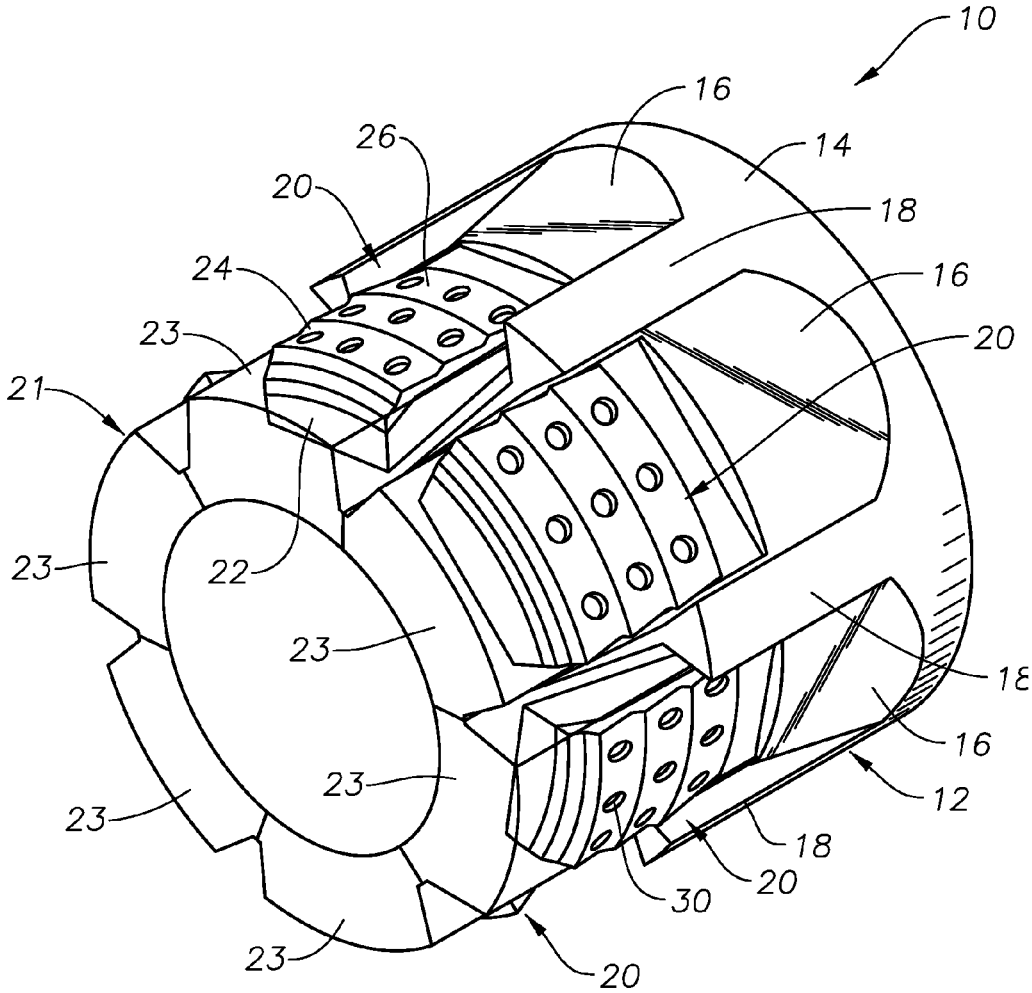
FIG. 1 is an isometric view of an exemplary bridge plug device constructed in accordance with the present invention.

FIG. 1 depicts an exemplary bridge plug device 10 constructed in accordance with the present invention. It is noted that the term "bridge plug," as used herein, is meant to refer expansively to a class of devices that use radially moveable slip elements to be mechanically set within a flowbore, including locks, plugs, and anchors. The bridge plug device 10 includes a setting cone 12 which is generally cylindrical. The outer radial surface 14 of the setting cone 12 includes a plurality of angled ramps 16 which are separated by guides 18. A slip element 20, constructed in accordance with the present invention, is located upon each of the ramps 16.

Figure 6:
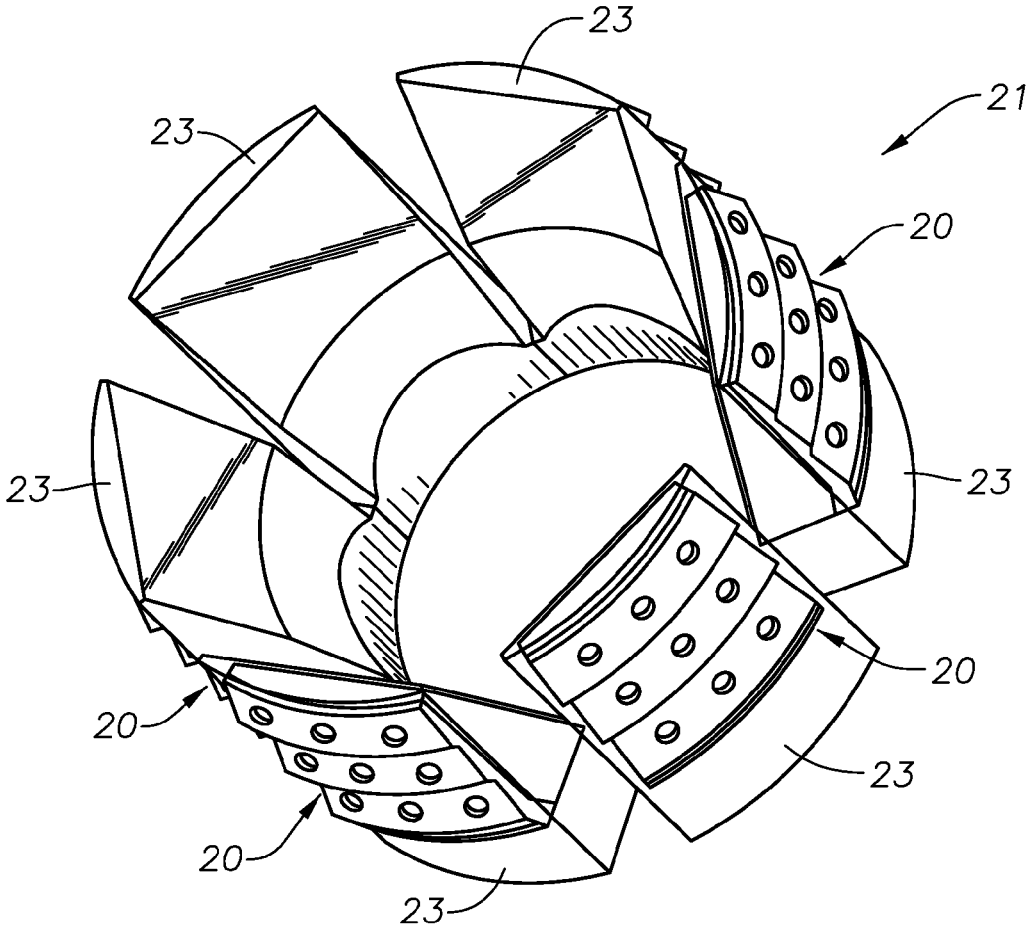
FIG. 6 is an isometric view of an exemplary slip ring which incorporates slip elements constructed in accordance with the present invention.

In preferred embodiments, the slip elements 20 are cast within a surrounding molding 21, which is best seen in FIG. 6. In particular embodiments, the molding 21 is formed of a phenolic resin and is cast in an annular ring shape having sheaths 23. The sheaths 23 each encase one of the slip elements 20. The molding 21 forms a slip ring which, as FIG. 1 illustrates, is disposed onto the setting cone 12 to form the bridge plug 10.

The slip elements 20 are moveable upon the ramps 16 of the setting cone 12 between the retracted, unset position shown in FIG. 1 and a set position, wherein the slip elements 20 are moved upon the ramps 16, in a manner known in the art, radially outwardly with respect to the setting cone 12. In the set position, the slip elements 20 of the bridge plug 10 are brought into engagement with a surrounding tubular member.

Figure 2:
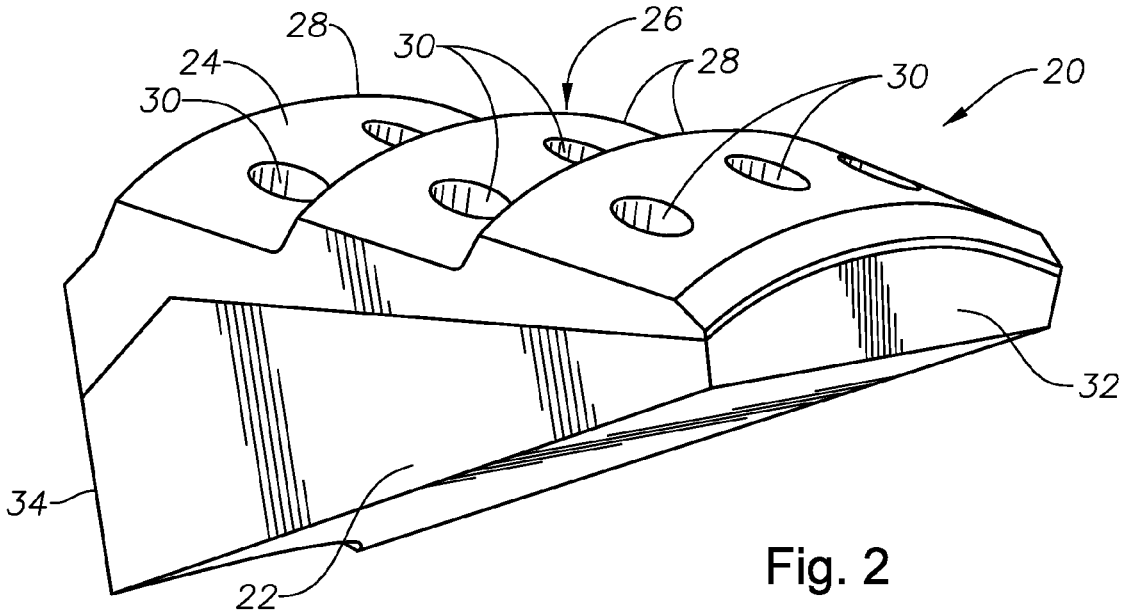
FIG. 2 is an isometric view of an exemplary slip element which is used with the bridge plug device shown in FIG. 1.
Figure 3:
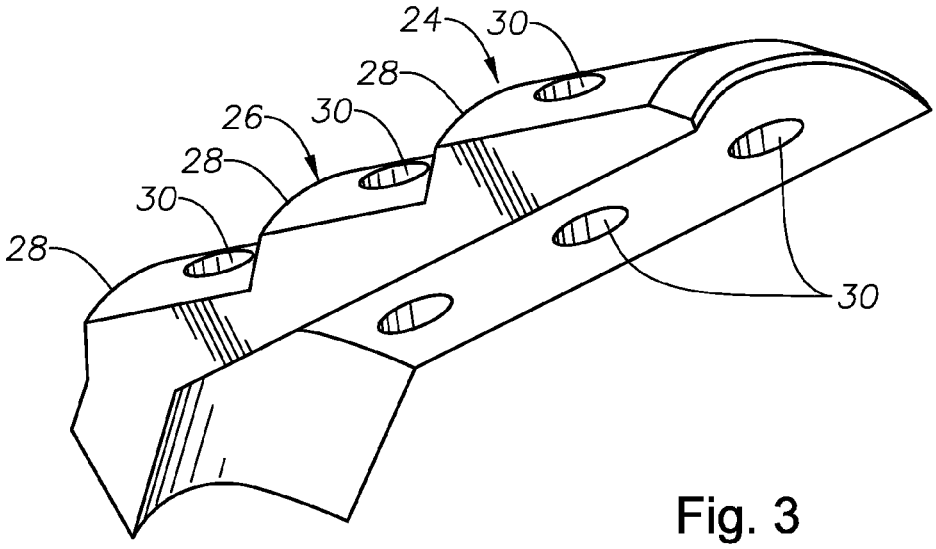
FIG. 3 is an isometric view of the exemplary outer contact portion of the slip element of FIG. 2.
Figure 4:
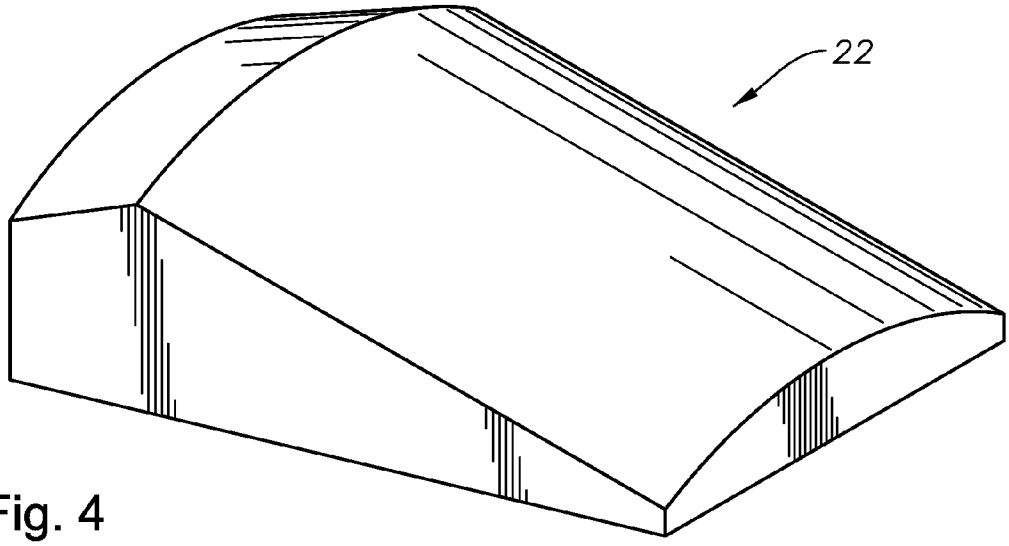
FIG. 4 is an isometric view of the exemplary inner body portion of the slip element of FIG. 2.
Figure 5:
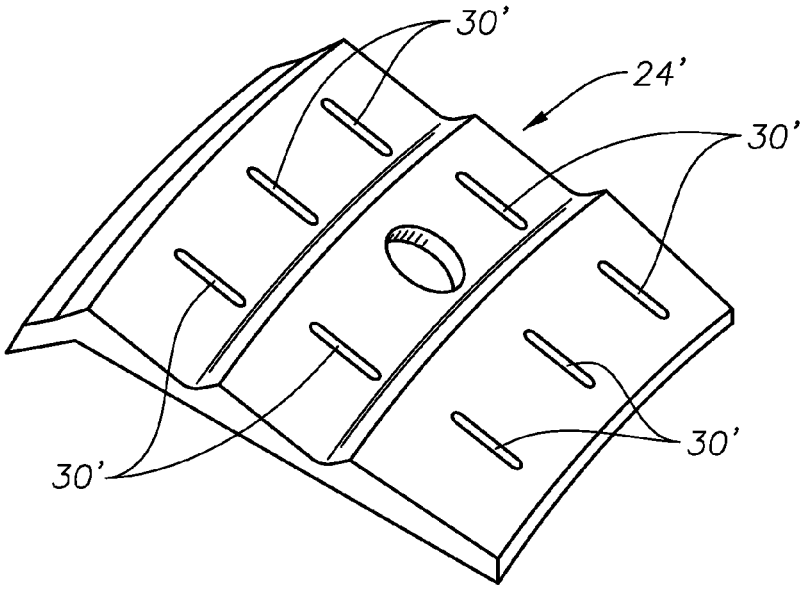
FIG. 5 is an isometric view of an exemplary alternative outer contact portion of the slip element in accordance with the present invention.

The structure of the slip elements 20 is better appreciated with reference to FIGS. 2 and 3. As FIG. 2 shows, the slip element 20 has a slip body which includes a radially inner body portion 22 and an outer contact portion 24. The inner body portion 22 is formed of a material that is substantially dissolvable in response to a dissolving agent. In a current embodiment, the inner body portion 22 is formed of magnesium-based composite powder compact. FIG. 4 illustrates the inner body portion 22 apart from other components. The inner body portion 22 is generally wedge shaped. The inner body portion 22 may be formed by high-pressure compression at high temperatures. Thereafter, the part is shaped by known mechanical processes.

In the instance wherein the dissolvable material is magnesium-based composite-powder compact, the dissolving agent may comprise various brines or acids often used in an oil or gas well. The brines include, but are no limited to, potassium chloride (kcl), sodium chloride (NaCl) and calcium chloride/calcium bromine (Ca2Cl/CaBr2). The acids include, but are not limited to, hydrogen chloride, acetic acid and formic acid. In particular embodiments, the dissolving agent is a solution that includes from about 2% to about 5% potassium chloride. In a particularly preferred embodiment, the dissolving agent is a solution that includes about 3% potassium chloride.

Also in present embodiments, the inner body portions 22 are entirely covered by the phenolic material forming the molding 21. As FIG. 1 illustrates, the contact surfaces 26 of the outer contact portions 24 may extend radially outside of the sheaths 23. This material acts as a laminate that separates the dissolvable material forming the inner body portion 22 from surrounding fluids which might contain one of more agents capable of dissolving the body portion 22.

FIG. 3 depicts the outer contact portion 24 apart from the body portion 22. The contact surface 26 of the contact portion preferably includes stepped wickers 28 formed thereupon to create a biting engagement with a surrounding tubular member.

In addition, openings 30 are preferably formed through the contact portion 24. The openings 30 introduce points of weakness in the structure of the portion 24. Thus, they serve as stress risers which assist the outer contact portion 24 in disintegration during removal of the bridge plug 10 by drilling. FIG. 6 depicts an alternative embodiment for an outer contact portion 24' which has a similar construction to the outer contact portion 24. However, the openings 30' are in the form of elongated slots.

The contact portion 24 (or 24') preferably extends from the upper end 32 to the lower end 34 of the slip element 20. The outer contact portion 24 (or 24') is preferably affixed to the body portion 22 using a suitable adhesive.

In operation, the bridge plug device 10 is run into a flowbore and then moved from its unset position to a set position, in a manner known in the art. The outer contact portions 24 (or 24') of the slip elements 20 engagingly contact the surrounding tubular member.

Figure 8:
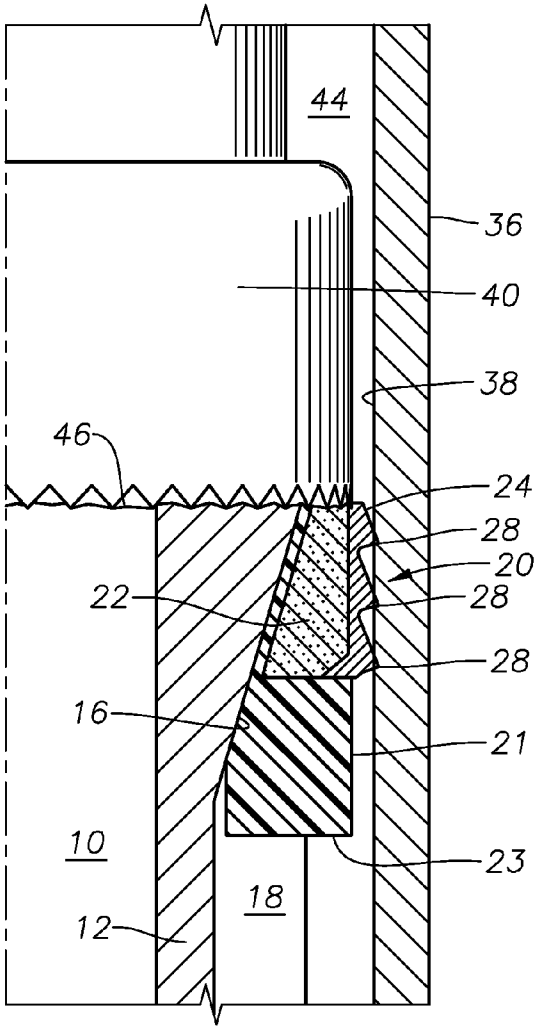
FIG. 8 is a one-quarter side cross-sectional view depicting removal by milling of an exemplary bridge plug from the surrounding tubular in accordance with the present invention.
Figure 7:
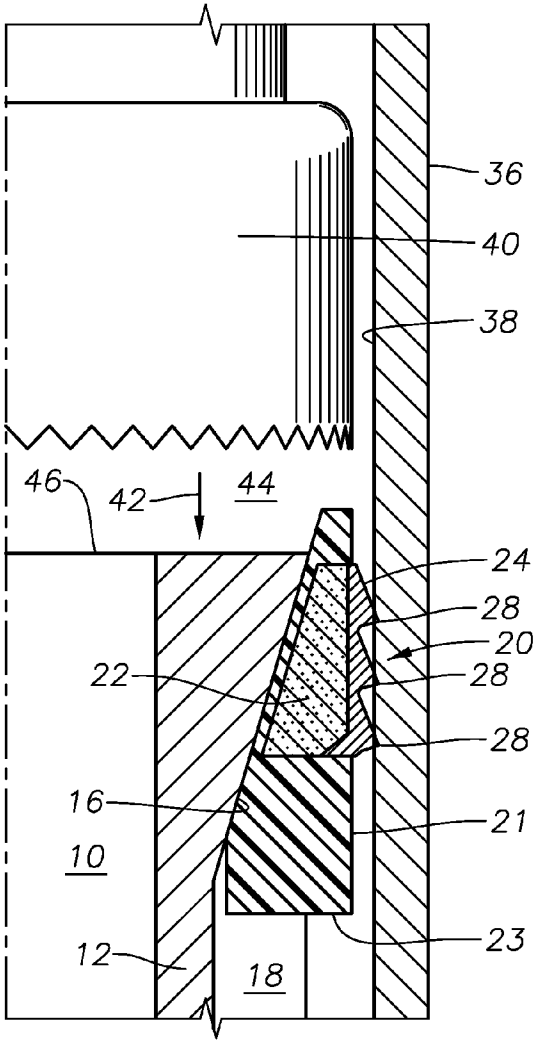
FIG. 7 is a one-quarter side cross-sectional view depicting an exemplary bridge plug in accordance with the present invention secured within a surrounding tubular.

When it is desired to remove the bridge plug device 10 from the flowbore, a drilling or milling device, of a type known in the art, contacts the bridge plug 10 and begins to destroy it by grinding action. FIG. 7 illustrates the bridge plug 10 having been set within a surrounding tubular member 36 such that the wickers 28 of the slip elements 20 (one shown) are set into the interior surface 38 of the tubular member 36 in an engaging contact. A milling tool 40 is disposed within the tubular member 36 and moved in the direction of arrow 42 through flowbore 44 toward engagement with the upper end 46 of bridge plug 10. As FIG. 8 shows, the milling tool 40 then engages and begins to mill away the upper end 46 of the bridge plug device 10. The setting cone 12 is abraded away. As the milling tool 40 encounters the slip elements 20, the phenolic material forming the slip ring molding 21 is milled through, as depicted, thereby exposing the inner body portions 22 to fluid within the flowbore 44. Dissolving agent is present in the fluid within the flowbore 44 and acts to dissolve the inner body portions 22 within the wellbore fluid. It is noted that potassium chloride in solution is typically present in conventional drilling fluids. In addition, the milling tool 40 will mill away the outer contact portions 24, and rupture the outer contact portions 24 into smaller component pieces due to the pattern of openings 30 which are disposed through the outer contact portions 24. The design of the slip inserts 20 will permit the bridge plug device 10 to be rapidly removed from the flowbore 44. In addition, a number of the components of the bridge plug device 10 can be more easily circulated out of the flowbore 44.

Those of skill in the art will recognize that numerous modifications and changes may be made to the exemplary designs and embodiments described herein and that the invention is limited only by the claims that follow and any equivalents thereof.

What is claimed is:

1. A slip element for a bridge plug device, comprising:

an inner body portion that is substantially formed of a dissolvable material that is substantially dissolvable in response to a dissolving agent, wherein the dissolvable material comprises magnesium-based composite powder; and an outer contact portion in contact with the inner body portion and being formed of a material suitable to provide engaging contact with a tubular member surrounding the bridge plug device and that is not dissolvable by the dissolving agent.

2. The slip element of claim 1 wherein the dissolving agent is from the group consisting essentially of potassium chloride, sodium chloride, calcium chloride, calcium bromine, hydrogen chloride, acetic acid and formic acid.

3. The slip element of claim 1 further comprising a laminate to preclude premature dissolution of the inner body portion.

4. The slip element of claim 1 wherein the inner body portion and the outer contact portion are affixed to each other by an adhesive.

5. The slip element of claim 1 further comprising a plurality of openings formed through the outer contact portion.

6. The slip element of claim 5 wherein the openings are circular in shape.

7. The slip element of claim 5 wherein the openings are elongated slots.

8. The slip element of claim 1 wherein the inner body portion presents a first axial end and a second axial end that is opposite the first axial end and wherein:

the outer contact portion extends from the first axial end to the second axial end.

9. A bridge plug device for forming a closure within a flowbore, the bridge plug comprising:

a setting cone;

a slip element that is selectively radially moveable with respect to the setting cone between unset and set positions, the slip element comprising:

an inner body portion substantially formed of a dissolvable material that is substantially dissolvable in response to a dissolving agent, wherein the dissolvable material comprises magnesium-based composite powder; and an outer contact portion in contact with the inner body portion and being formed of a material suitable to provide engaging contact with a tubular member surrounding the bridge plug and that is not dissolvable by the dissolving agent.

10. The bridge plug of claim 9 further comprising a laminate to preclude premature dissolution of the inner body portion.

11. The bridge plug of claim 9 wherein the dissolving agent is from the group consisting essentially of potassium chloride, sodium chloride, calcium chloride, calcium bromine, hydrogen chloride, acetic acid and formic acid.

12. The bridge plug of claim 9 wherein the inner body portion and the outer contact portion are affixed to each other by an adhesive.

13. The bridge plug of claim 9 wherein the inner body portion presents a first axial end and a second axial end that is opposite the first axial end and wherein:

the outer contact portion extends from the first axial end to the second axial end.

14. The bridge plug of claim 9 further comprising a plurality of openings formed through the outer contact portion.

15. The bridge plug of claim 14 wherein the openings are circular in shape.

16. The bridge plug of claim 14 wherein the openings are elongated slots.

17. A method of removing a bridge plug that is set within a flowbore from the flowbore, comprising the steps of:

a) engaging a top portion of the bridge plug with a milling tool, the bridge plug having:

a setting cone;

a slip element that is selectively radially moveable with respect to the setting cone between unset and set positions, the slip element comprising:

an inner body portion substantially formed of a dissolvable material that is substantially dissolvable in response to a dissolving agent;

an outer contact portion in contact with the inner body portion and being formed of a material suitable to provide engaging contact with a tubular member surrounding the bridge plug device and that is not dissolvable by the dissolving agent;

a molding surrounding the inner body portion;

b) milling away a portion of the molding to at least partially expose the inner body portion to the flowbore; and c) flowing a dissolving agent within the flowbore to dissolve the inner body portion.

18. The method of claim 17 wherein the outer contact portion has a plurality of openings disposed therethrough to create points of weakness; and the method further comprises the step of:

rupturing the outer contact portion with the milling tool into smaller components.

* * * * *